US005757004A

United States Patent [19]

Sandell et al.

[11] Patent Number: 5,757,004

[45] Date of Patent: May 26, 1998

[54] MOTION DETECTOR WITH EXTERNAL RANGE ADJUSTMENT

[75] Inventors: Donald R. Sandell, San Jose; Wade Lee, Lafayette, both of Calif.

[73] Assignee: Larry C. Y. Lee, Lafayette, Calif.

[21] Appl. No.: 696,016

[22] Filed: Aug. 9, 1996

Related U.S. Application Data

[60] Provisional application No. 60/002,199 Aug. 11, 1995.

[51] Int. Cl.[6] ..... G08B 13/193; G08B 13/19

[52] U.S. Cl. ..... 250/347; 250/353

[58] Field of Search ..... 250/342, 347, 250/353, DIG. 1

[56] References Cited

U.S. PATENT DOCUMENTS 5,103,346 4/1992 Chang ..... 250/353 X
5,434,764 7/1995 Lee .

FOREIGN PATENT DOCUMENTS 3710614 10/1988 Germany ..... 250/DIG. 1
4023341 1/1992 Germany ..... 250/DIG. 1
4027347 9/1993 Germany .
2122339 1/1984 United Kingdom ..... 250/DIG. 1

*Primary Examiner*—Edward J. Glick
*Attorney, Agent, or Firm*—Elliot B. Aronson

[57] ABSTRACT

A motion detector with a lens-sensor mounting and adjustment arrangement that permits a user to adjust the effective range of the motion detector without altering the sensor's sensitivity settings. The mounting arrangement provides for relative movement of the sensor in relation to the lens matrix through an adjustment accessible to a user from outside the motion detector housing. In a disclosed embodiment a sensor is mounted on a printed circuit board that is disposed to slide on elongate rails. An expansible actuator assembly includes a threaded traveling member coupled to a threaded drive member, one end being accessible through the motion detector housing for engagement by a user and the other end being coupled to the printed circuit board so as to actuate movement of the sensor with respect to the lens.

8 Claims, 6 Drawing Sheets

FIG._4A
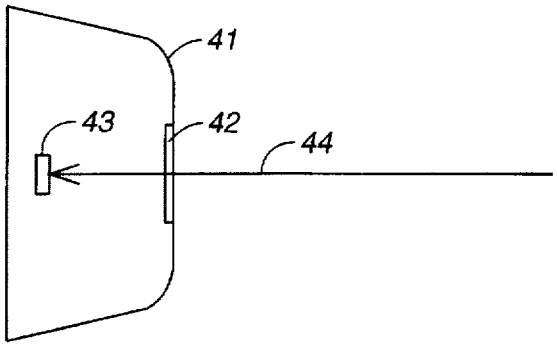
FIG._4B
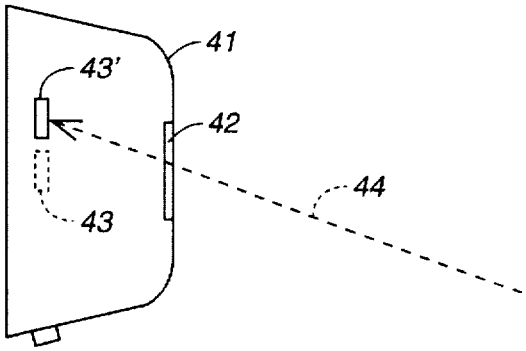
FIG._4C
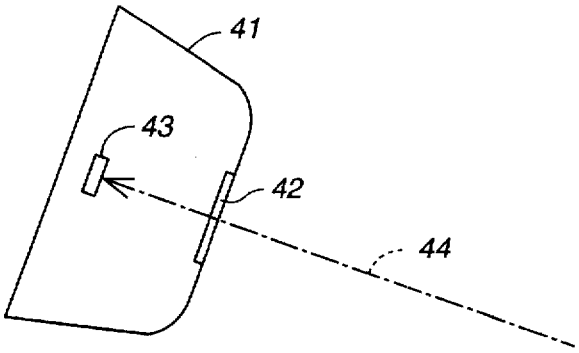
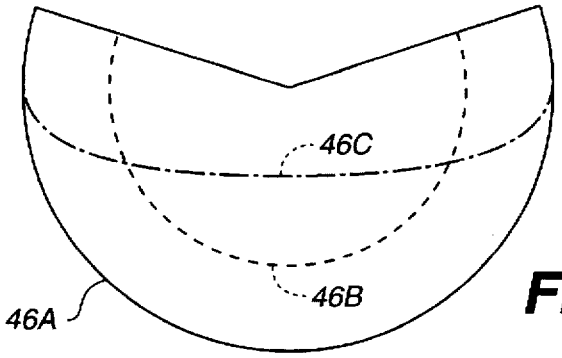
FIG._5

MOTION DETECTOR WITH EXTERNAL RANGE ADJUSTMENT

This application claims the benefit of U.S. Provisional application Ser. No. 60/002,199, filed Aug. 11, 1995.

BACKGROUND OF THE INVENTION

The present invention relates to passive infrared motion detector devices and is particularly directed to mechanisms for establishing the range and field of view of the devices.

Infrared motion detector devices are commonly used in automatic light switches and security systems to turn on a light or to activate some other form of alarm or warning indicator when a person or motor vehicle enters a monitored area. Such devices may be used in residential lighting, for example, to illuminate a walkway as a person approaches the front door or to illuminate a driveway as a car drives in.

In one form of popular motion detector lighting fixture, a sensing element responsive to infrared radiation is mounted in its own housing—commonly referred to as the "sensor head"—that also typically contains associated optical elements and electronic circuitry. The optical and sensing elements are typically anchored in fixed disposition within the sensor head and define a fixed field of view with respect to the sensor head, within which the device will be responsive to infrared targets. The sensor head is attached to the lighting fixture through an articulated link that permits the head to be aimed in a desired direction. In a particular installation the sensor head may be aimed at a desired height or turned to one side or the other to account for such factors as the height above the ground at which the fixture is mounted and the topography of the terrain in front of and to the sides of the fixture.

Articulated mounting arrangements often have the undesirable property that they are not aesthetically pleasing. They are also undesirable because of a technical limitation. As the sensor head is adjusted up or down, the angular width and range of the field of view are distorted. So, for example, as an articulated sensor head is turned downward, say, to compensate for a high mounting height, the effective range on the sides is increased and the range in the front is reduced. For motion detector units with a narrow field of view which are highly preferential to the forward direction, this distortion has generally been tolerated. For wider fields of view, and in particular for fields of view greater than 180 degrees, the distortion in the width becomes more bothersome. Attempts to deal with this problem in the past have included placing strict limitations on permitted mounting configurations in the installation instructions, or providing blinders on the unit to control the radial detection pattern, or simply accepting the distorted field as a tolerable tradeoff for the aiming capability of an articulated sensor head.

SUMMARY OF THE INVENTION

The present invention provides a motion detector with a lens-sensor mounting and adjustment mechanism that overcomes the above tradeoff. The mounting mechanism of the invention provides a means of providing relative movement of the sensor in relation to the lens matrix of the motion detector without moving the sensor head overall. With this mounting mechanism the user may increase or reduce the effective range of the motion detector without altering the sensor's sensitivity settings. As a result, false activation signals are reduced and the zonal density within the field of view pattern is increased, and this allows for consistent range adjustments throughout the detection pattern. The motion detector according to the invention provides for relative movement of the sensor with respect to the lens matrix by means of an adjustment accessible to a user from outside the motion detector housing.

Other aspects, advantages, and novel features of the invention are described below or will be readily apparent to those skilled in the art from the following specifications and drawings of illustrative embodiments.

BRIEF DESCRIPTION OF THE DRAWINGS

FIG. 4A is a diagrammatic view of a sensor head showing the relative disposition of sensor and lens in optimal configuration.

FIG. 4B is a diagrammatic view of a sensor head showing the shifted disposition of sensor and lens according to the invention.

FIG. 4C is a diagrammatic view of a sensor head showing the disposition of sensor and lens with the sensor head turned to a different direction from that of FIG. 4A.

FIG. 5 shows the field-of-view patterns corresponding to the sensor heads of FIGS. 4A, 4B and 4C.

DETAILED DESCRIPTION OF ILLUSTRATIVE EMBODIMENTS

Figure 1:
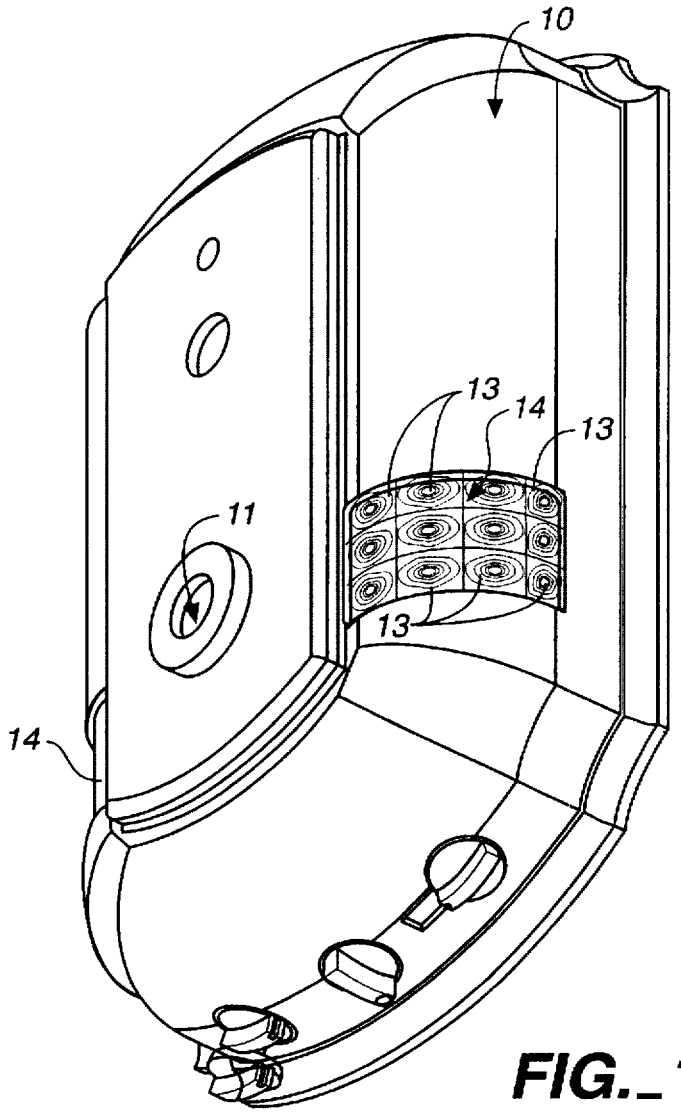
FIG. 1 is an overall perspective view of a motion detector having an external range adjustment according to the invention.

A first embodiment of an adjustable motion detector according to the invention is described with reference to FIGS. 1–3A. A motion detector housing 10 is shown in the form of a base for a light fixture (not shown). The base is mounted, for example, on an exterior wall of a house. An opening 11 is provided in the front face of housing 10 for securing a light fixture controlled by the motion detector. The form of light fixture plays no role in the present invention and has been omitted so as not to obscure the drawings. Included within the housing is a pair of infrared sensors 12 and a means for focusing infrared radiation toward the sensors 12. The sensor is commonly provided by an integrated-circuit chip containing two side-by-side sensing elements behind a window on the surface of the chip. Such chips are well known in the art and need not be described further here. Although not specifically illustrated here, other sensor arrangements may be used with the present invention, for example, arrangements employing only one sensor chip or more than two sensor chips or a sensor chip containing a more complex configuration of sensing elements.

In FIGS. 1–3A the radiation is directed to the sensors by an array of individual Fresnel lenslets 13 formed on a plastic lens matrix member 14. The structure and operation of such lens arrays in infrared motion detector devices is well known and need not be described here in detail. The plurality of lenslets 13 together with the sensors 12 define a plurality of detection zones comprising the field of view of the motion detector. Motion is detected when a moving infrared source such as a person or an automobile enters or leaves at least one of the detection zones. The precise disposition of the zones is determined by relative positioning of sensors 12 and lenslets 13.

Figure 2:
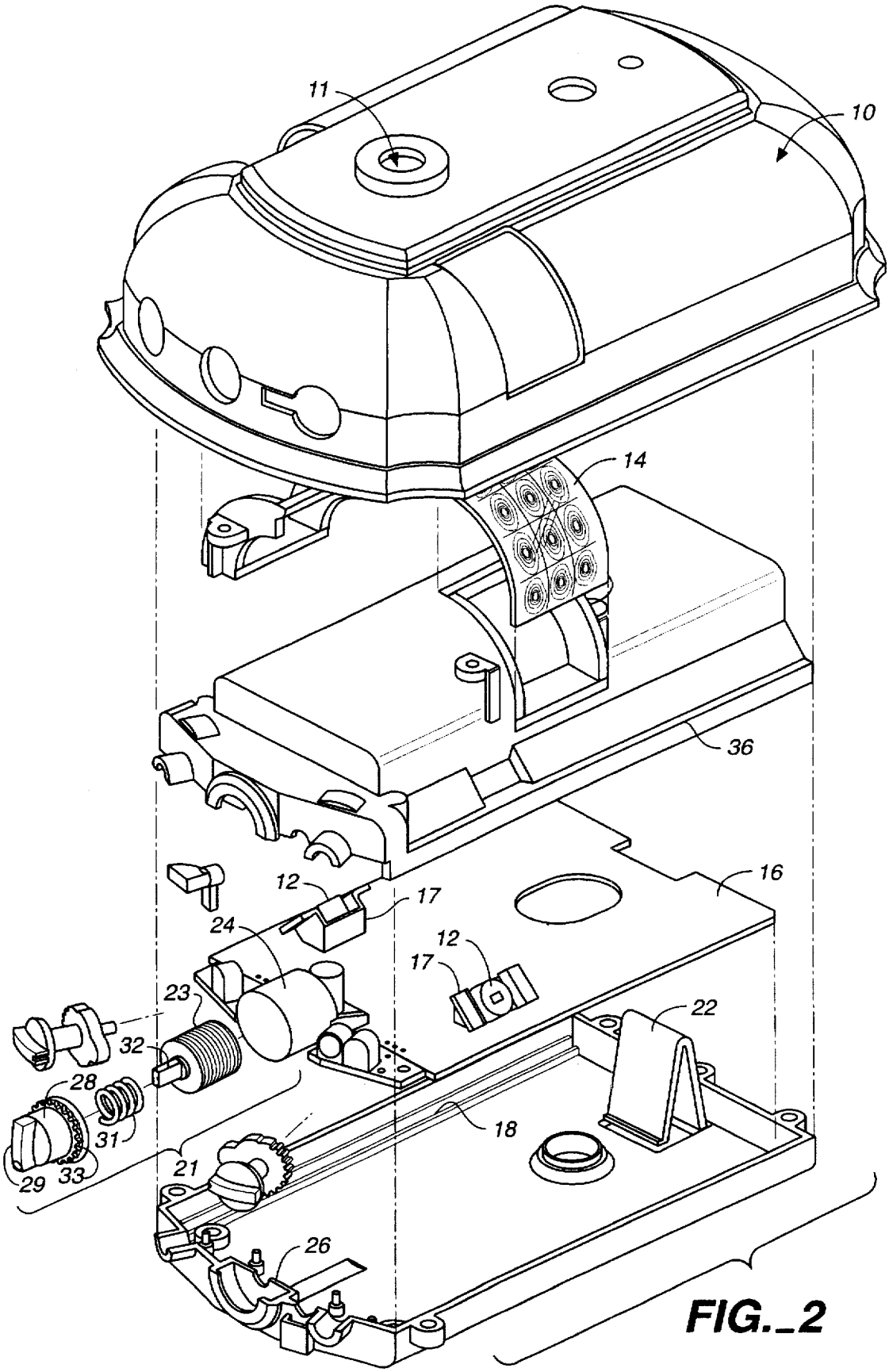
FIG. 2 is an exploded perspective view of an embodiment of a motion detector with range adjustment.

In the present invention that relative positioning may be simply adjusted by a user from the exterior of the housing 10 without the need to open or disassemble the housing. To that end, the motion detector housing includes a movable support member on which either the focusing elements or the sensors are mounted. In the embodiment of FIGS. 1–3A the support member is provided by printed circuit board 16, on which the sensors 12 are mounted. As seen in FIG. 2 sensors 12 are maintained at the desired angle and position on the printed circuit board by angled mounting brackets 17. Printed circuit board 16 rides on rails 18 and may be moved linearly along the rails to produce relative movement of sensors 12 and lens members 14.

Figure 3:
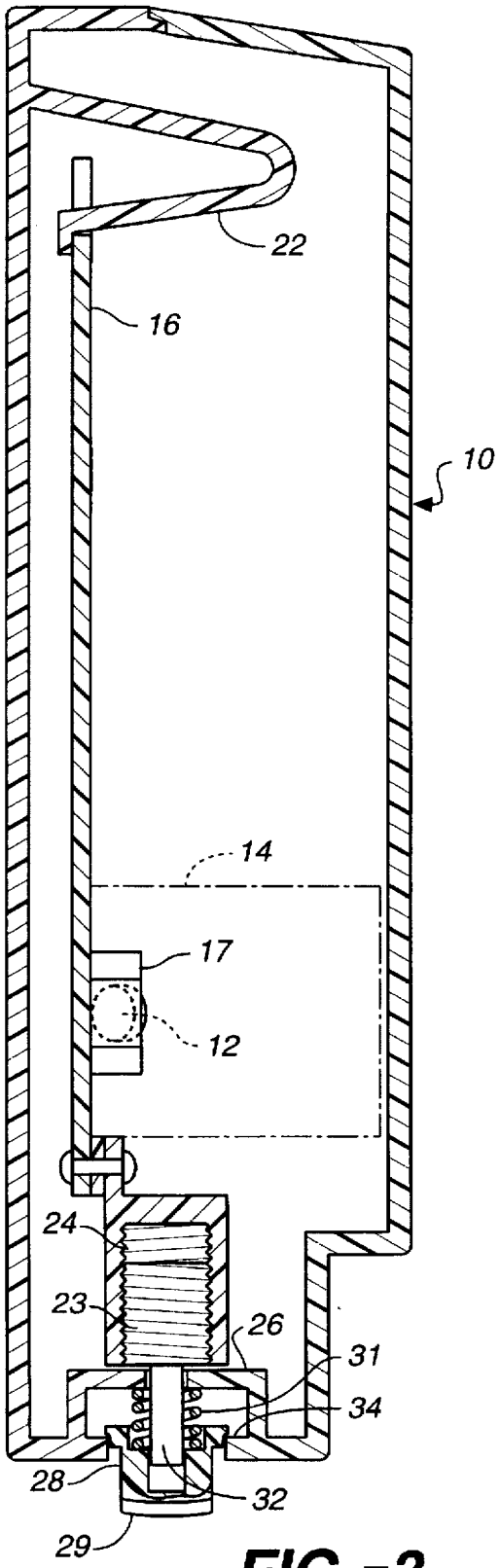
FIG. 3 is a cross-sectional view of an embodiment of the invention.
Figure 3A:
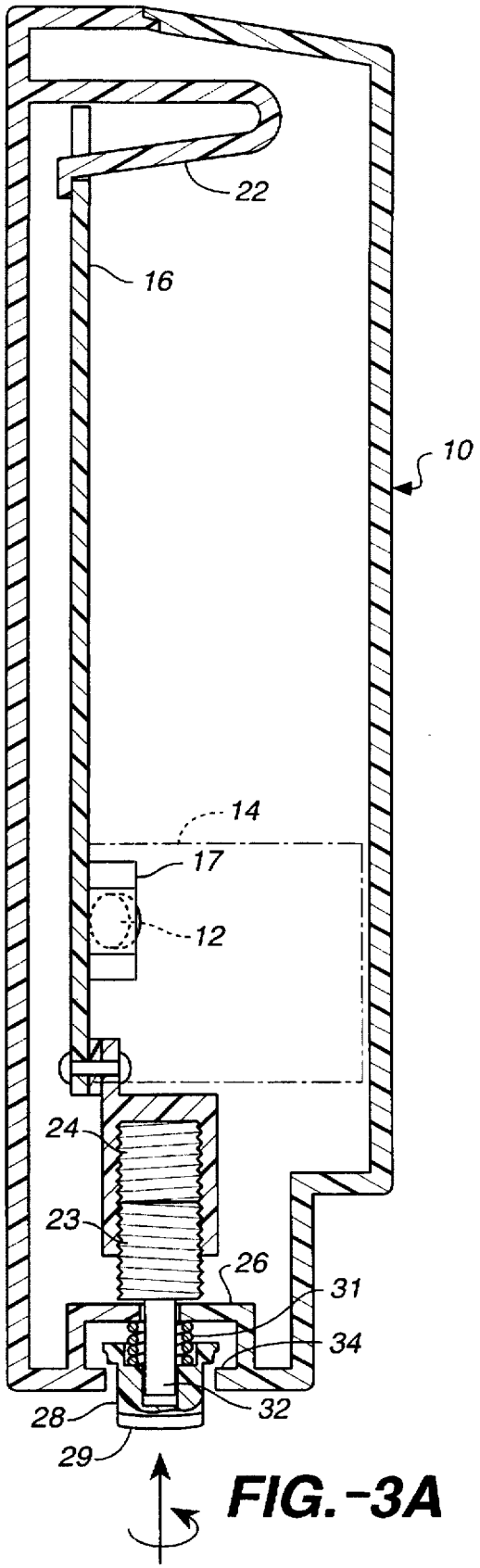
FIG. 3A is the cross-sectional view of FIG. 3 with the sensor in shifted position.

The relative movement of sensors and lens members is brought about by an actuator assembly coupled to the support member. In the embodiment of FIGS. 1–3A the actuator assembly is provided by the assembly indicated generally at reference numeral 21 together with spring biasing member 22. Actuator assembly 21 includes a screw assembly structured for rotary extension and retraction and comprising a drive screw member 23 and a traveling screw member 24, which are threaded together. Traveling screw member 24 is fixed to printed circuit board 16, and drive screw member 23 is held in position behind retaining wall 26 forming a part of the housing. Drive screw member 23 is urged against retaining wall 26 by spring biasing member 22, which is compressed so as to urge printed circuit board 16 and the affixed traveling screw member 24 in the direction of retaining wall 26. For clarity of illustration FIGS. 3 and 3A show a small gap between the end face of drive screw member 23 and the face of retaining wall 26, although in operation the two faces contact one another.

Actuator assembly 21 includes an engagement member which extends to the exterior of the motion detector housing and by which a user may adjust the position of the support member and hence the relative positioning of the sensors and lens members. In the embodiment of FIGS. 1–3A the engagement member is provided by a push knob 28 having a protruding ridge 29 for the user to grasp. Push knob 28 extends through an opening in motion detector housing 10 so as to be accessible to a user. To adjust the position of printed circuit board 16, the user pushes in the knob 28 against the tension of spring 31 and rotates the knob. The hollow interior of ridge 29 captures projecting tongue 32 and causes drive screw member 23 to turn. FIG. 3 shows a relative disposition in which sensor 12 is positioned roughly in the vertical center with respect to lens member 14. In FIG. 3A knob 28 is pushed in to compress spring 31, and drive screw member 23 has been rotated so as to extend the drive and traveling screw members and thereby urge printed circuit board 16 away from knob 28. As a result, sensor 12 is now positioned closer to the top edge of lens member 14.

Knob 28 is formed with a plurality of detents 33 around its circumference which engage a corresponding stop on the inside of the housing. The stop may be provided by one or more bumps on inner edge 34 projecting inward and mating with detents 33. The detents serve to hold the knob firmly in position so as to maintain the disposition of lens member and sensor. Some form of locking mechanism is desired to hold the movable support member in place. Without such a locking mechanism there is a tendency for the movable support member, here the printed circuit board 16, to creep under the action of vibration transmitted through the wall, for example, due to repeated opening and closing of a nearby door. While a push knob with detents has been described here, this is only offered by way of example, and other locking methods such as friction locks, locking tabs and others may also be used.

To provide further mechanical and optical stability against ambient vibration, in the embodiment of FIGS. 1–3A printed circuit board 16 rides on the elongate rails 18 and is captured against the rails by overlying member 36. This arrangement has the advantage that it is less costly to fabricate and assemble because the rails may be molded into the inside of the plastic housing and the need for additional component parts is thereby avoided.

The engagement member must be accessible to a user without disassembling the housing. For protection or concealment, however, the engagement member may be covered with a removable protective cap or may be disposed in a protective recess. A protective cap or recess may be desirable for example to prevent the setting from being changed unintentionally. Such dispositions do not require disassembly of the housing to engage the engagement member and do not interfere with the purpose of the invention.

The effect and advantages of the relative movement of sensor and lens member may now be appreciated and is described with reference to FIGS. 4A–4C, which show diagrammatic representations of a motion detector housing 41 with lens member 42 and sensor 43. Infrared ray path 44 depicts the path of infrared radiation from a target in the field of view passing through a central lenslet of lens member 42. FIG. 4A shows a neutral disposition, in which housing 42 is aimed straight ahead and sensor 43 is disposed to look straight ahead. The representative ray 44 striking sensor 43 is horizontal. FIG. 4B depicts the disposition of lens member and sensor after adjustment according to the present invention. The sensor is moved from the position 43 to the new position 43', housing 41 and lens member 42 continue to be aimed straight ahead, and the result is that sensor 43' now looks downward. FIG. 4C depicts the disposition achieved in the prior art. The entire housing 42 is rotated to face downward, but lens member 42 and sensor 43 are in the same relative disposition as in FIG. 4A. FIG. 5 shows the effect on the field-of-view pattern. The contour 46A is the contour of the field-of-view pattern achieved with the motion detector disposition shown in FIG. 4A. The contours 46B and 46C correspond to the field-of-view patterns achievable in FIGS. 4B and 4C, respectively. With the present disposition the shape of the contour is maintained. In the prior art the responsiveness in the forward direction is disproportionately diminished compared with the responsiveness to the sides.

An example is offered to show the typical amount of relative movement that can be expected. To adjust the depth of the field of view over a range of 20 to 40 feet with a focusing element having a 0.9-inch focal length, roughly 6 mm of relative movement is needed. If too much relative movement is achieved, then once the diameter of the focused radiation energy exceeds 1 mm (i.e., the distance between the two detector elements in a standard integrated-circuit infrared sensor chip), then the sensor ceases to function effectively. For typical motion detector lighting fixtures, focal lengths commonly fall in the range of 0.5 to 2 inch.

Figure 6:
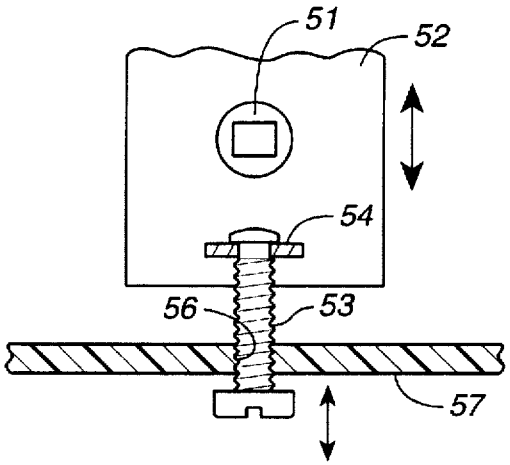
FIG. 6 is a sectional view showing a simple screw adjustment mechanism.
Figure 7:
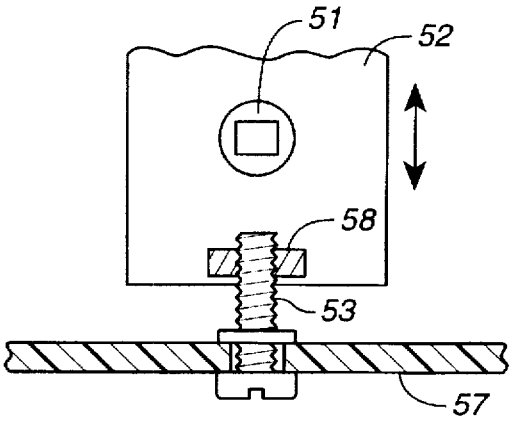
FIG. 7 is a sectional view showing an alternative simple screw adjustment mechanism.
Figure 8:
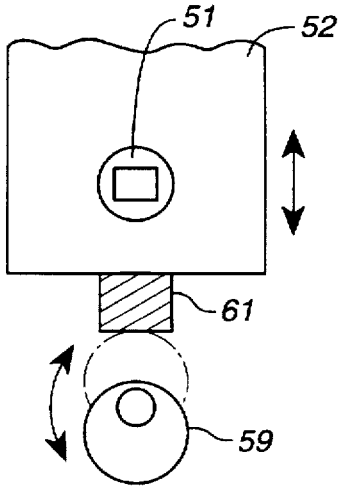
FIGS. 8 and 8A are sectional views showing a cam adjustment mechanism.
Figure 8A:
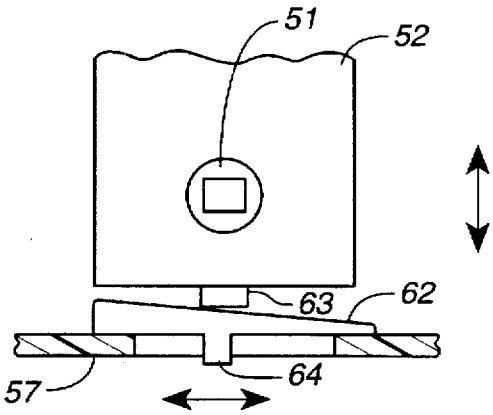

FIGS. 6–8A illustrate alternative configurations for producing the relative movement of lens member and sensor. In these configurations sensor 51 is shown mounted on support member 52, which may be provided by a printed circuit board. In FIG. 6 a threaded shaft 53 is captured at one end by bracket 54 at the support member and is free to rotate in the bracket. Shaft 53 turns in a tapped bore 56 through a wall 57 that is fixed with respect to the detector housing. In FIG. 7 the shaft 53 is captured at the wall 57 to freely rotate, and a tapped bracket 58 is fixed to support member 52. In FIG. 8 a rotating cam 59 engages a cam follower 61 that is fixed to support member 52 and that is biased against cam 59. Cam 59 is connected to an engagement member by which the user rotates the cam. FIG. 8A shows a variation of the eccentric cam of FIG. 8. In FIG. 8A a sliding wedge member 62 engages cam follower 63. Sliding engagement button 64 protrudes through wall 57 for engagement by the user.

Figure 9:
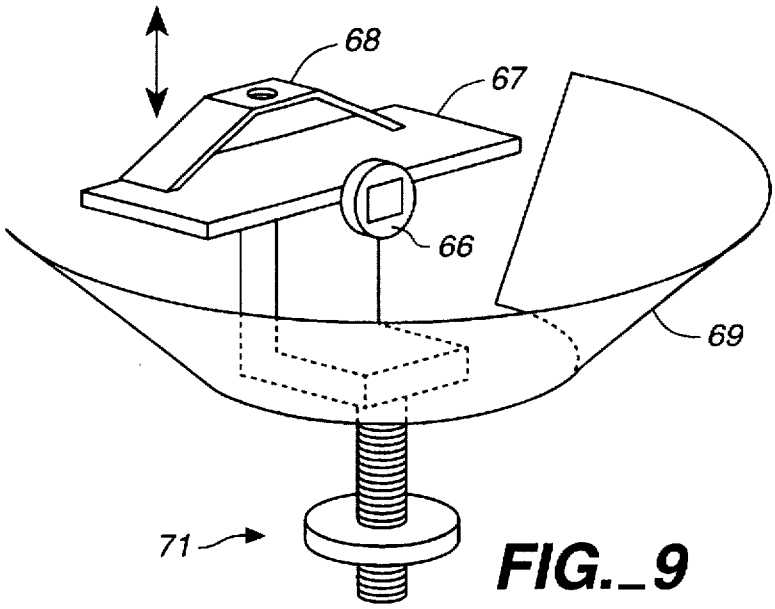
FIG. 9 is a perspective view showing an embodiment of the invention for use with a conical lens arrangement.
Figure 10:
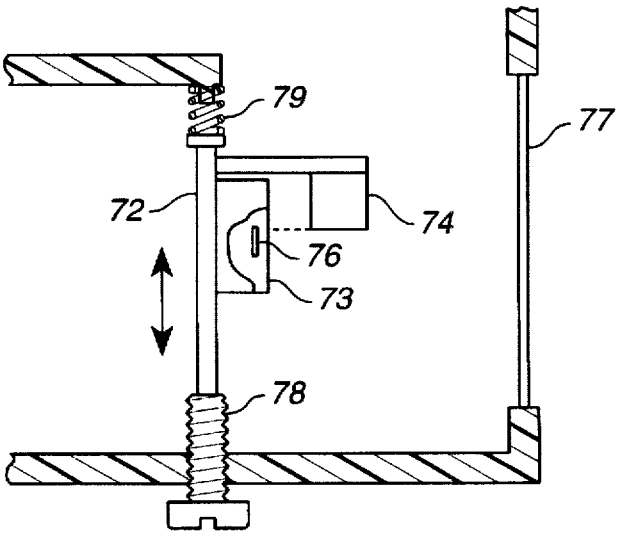
FIG. 10 is an elevational view showing an embodiment of the invention including a sensor with associated mirror arrangement.

FIGS. 9 and 10 show alternative configurations of lens and optical elements. In FIG. 9 sensor 66 is fixed to support member 67, which is urged downward by leaf spring 68. Lens member 69 has the form of a section of a cone, and support member 67 is constrained to move along the axis of the cone. A threaded-shaft actuator assembly 71 is illustrated diagrammatically. In FIG. 10 support member 72 supports sensor 73 and a wedge-shaped reflector 74. Sensor 73 is a standard integrated-circuit sensor chip including two small, parallel sensing elements 76. The reflector 74 is positioned to overlie a portion of the sensor elements 76. The lenslets of lens member 77 are arranged to direct infrared radiation to sensing elements 76 by reflection off the reflective surfaces of wedge reflector 74 and by a straight path to the unobstructed portions of sensing elements 76. Support member 72 is moved by the action of threaded actuator shaft 78 pushing against the bias from spring 79. Movement of support member 72 now moves an entire optical assembly and not just a sensor. Nevertheless, the advantages of the invention may still be obtained.

For purposes of the present invention it is important that the actuator means produce a controlled movement of the sensor support member in a prescribed direction with respect to the lens without moving the motion detector housing overall. As illustrated here the actuator assembly produces a movement along a vertical axis with respect to the lateral spread of the field of view for rotating the field of view up and down. In some circumstances it may be desirable to adjust the relative side-to-side positioning of the sensor and lens as well.

The above descriptions and drawings disclose illustrative embodiments of the invention. Given the benefit of this disclosure, those skilled in the art will appreciate that various modifications, alternate constructions, and equivalents may also be employed to achieve the advantages of the invention. Therefore, the invention is not to be limited to the above description and illustrations, but is defined by the appended claims.

What is claimed is:

1. A passive infrared motion detector including a housing, an infrared sensor within the housing, and a focusing means comprising a lens member mounted in fixed relation to said housing, said lens member having a plurality of lenslets formed thereon configured to direct infrared radiation to the sensor from a plurality of zones in the field of view of the motion detector, wherein said plurality of zones includes at least one laterally extending row of zones, wherein said motion detector comprises:

a support member, wherein said sensor is mounted on said support member, and wherein said support member is mounted for movement in a generally vertical direction perpendicular to said at least one laterally extending row so as to enable relative movement of said sensor and said lens member within a range causing said field of view to be displaced generally up and down; and an actuator assembly coupled to said support member for actuating said movement thereof and thereby effecting said relative movement of said sensor and said lens member, wherein said actuator assembly includes an engagement member formed for engagement by a user for driving said actuator assembly, and said engagement member is disposed to be accessible from the exterior of said housing for engagement by said user without disassembling said housing and with said motion detector mounted in position for use;

whereby said user may adjust the relative position of said sensor and said lens member, and thereby adjust the disposition of the field of view of said motion detector, without disassembling said housing and with said motion detector mounted in position for use.

2. The apparatus of claim 1 wherein said actuator assembly comprises:

a screw assembly structured for rotary extension and retraction, said screw assembly coupling said support member to said engagement member, whereby turning said engagement member brings about said movement of said support member; and wherein said screw assembly comprises a threaded shaft connected at a first end thereof to said engagement member and a receiving member having a threaded hole formed therein for receiving said threaded shaft.

3. The apparatus of claim 2 wherein said receiving member is fixed in relation to said housing; and an end of said threaded shaft remote from said engagement member is mechanically retained at said support member.

4. The apparatus of claim 2 wherein said receiving member is fixed in relation to said support member; and said first end of said threaded shaft is retained at said housing.

5. The apparatus of claim 1, further comprising spring biasing means for biasing said support member so as to suppress play in said support member.

6. The apparatus of claim 1 wherein said actuator assembly comprises:

cam means connected to said engagement member and mounted to actuate said movement of said support member.

7. The apparatus of claim 1 further comprising locking means for locking said actuator assembly in position against the action of background vibration of said housing.

8. A passive infrared motion detector including a housing, an infrared sensor within the housing, and a focusing means comprising a lens member having a plurality of lenslets formed thereon configured to direct infrared radiation to the sensor from a plurality of zones in the field of view of the motion detector, wherein said plurality of zones includes at least one laterally extending row of zones, wherein said motion detector comprises:

a support member, wherein said sensor is mounted on said support member, and wherein said support member is mounted for movement in a generally vertical direction perpendicular to said at least one laterally extending row so as to enable relative movement of said sensor and said lens member within a range causing said field of view to be displaced generally up and down; and an actuator assembly coupled to said support member for actuating said movement thereof and thereby effecting said relative movement of said sensor and said lens member, wherein said actuator assembly includes an engagement member formed for engagement by a user for driving said actuator assembly, and said engagement member is disposed to be accessible from the exterior of said housing for engagement by said user without disassembling said housing and with said motion detector mounted in position for use; and wherein said actuator assembly further comprises a screw assembly structured for rotary extension and retraction, said screw assembly coupling said support member to said engagement member, whereby turning said engagement member brings about said movement of said support member; and wherein said screw assembly comprises a traveling member and a drive member threadedly coupled to said traveling member, wherein said traveling member is connected to said support member and said drive member is connected to said engagement member;

whereby said user may adjust the relative position of said sensor and said lens member and thereby adjust the disposition of the field of view of said motion detector without disassembling said housing and with said motion detector mounted in position for use.

* * * * *